US007216958B2

(12) United States Patent
Lee et al.

(10) Patent No.: US 7,216,958 B2
(45) Date of Patent: May 15, 2007

(54) METHOD OF EXPELLING A FLUID USING AN ION WIND AND INK-JET PRINTHEAD UTILIZING THE METHOD

(75) Inventors: You-seop Lee, Yongin-si (KR); Yong-soo Oh, Seongnam-si (KR); Seung-joo Shin, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 263 days.

(21) Appl. No.: 10/757,394

(22) Filed: Jan. 15, 2004

(65) Prior Publication Data

US 2004/0145621 A1 Jul. 29, 2004

(30) Foreign Application Priority Data

Jan. 15, 2003 (KR) ..... 10-2003-0002728

(51) Int. Cl.
*B41J 2/06* (2006.01)

(52) U.S. Cl. ..... 347/55

(58) Field of Classification Search ..... 347/20, 347/21, 44, 47, 55, 75–77
See application file for complete search history.

(56) References Cited

U.S. PATENT DOCUMENTS 4,672,397 A * 6/1987 Suga et al. ..... 347/21
4,736,212 A 4/1988 Oda et al.
4,882,595 A 11/1989 Trueba et al. ..... 346/140
5,144,340 A * 9/1992 Hotomi et al. ..... 347/55
5,895,702 A * 4/1999 Takeuchi et al. ..... 428/137
6,028,615 A * 2/2000 Pletcher et al. ..... 347/127
6,127,082 A * 10/2000 Humberstone et al. ..... 430/117
6,158,844 A * 12/2000 Murakami et al. ..... 347/55
6,394,575 B1 5/2002 Kent ..... 347/21

FOREIGN PATENT DOCUMENTS

JP 11-28818 2/1999

OTHER PUBLICATIONS

Patent Abstracts of Japan, vol. 009, No. 183 (M-400), Jul. 30, 1985 & JP 60- 052353 (Nippon Denki KK*.
*Equivalent=US 4,672,397.
Patent Abstracts of Japan, vol. 1999, No. 05, May 31, 1999, & JP 11 028818 (Sharp Corp.).
Patent Abstracts of Japan, vol. 012, No. 371 (M-748), Oct. 5, 1988 & JP 63 122553 (Fuji Xerox Co.).

* cited by examiner

*Primary Examiner*—An H. Do
(74) *Attorney, Agent, or Firm*—Lee & Morse, P.C.

(57) ABSTRACT

A method of expelling a fluid includes filling a nozzle with a fluid using a capillary force, generating an ion wind by ionizing air near an outlet of the nozzle, and expelling the fluid from the nozzle as the ion wind decreases a pressure around the outlet of the nozzle. An ink-jet printhead utilizing the method includes a manifold formed in a passageway plate to supply ink, a nozzle to be supplied with ink formed in a nozzle plate provided on the passageway plate, and a ground electrode and a source electrode arranged near an outlet of the nozzle, the ground electrode and the source electrode forming an electric field due to an application of a voltage thereto and ionizing air near the outlet of the nozzle to produce an ion wind to decrease a pressure near the outlet of the nozzle to expel the ink contained in the nozzle.

25 Claims, 8 Drawing Sheets

METHOD OF EXPELLING A FLUID USING AN ION WIND AND INK-JET PRINTHEAD UTILIZING THE METHOD

BACKGROUND OF THE INVENTION

1. Field of the Invention

The present invention relates to a method of expelling a fluid. More particularly, the present invention relates to a method of expelling a fluid from a nozzle using an ion wind and an ink-jet printhead utilizing the method.

2. Description of the Related Art

Typically, ink-jet printheads are devices for printing a predetermined image, color or black, by ejecting a small volume droplet of printing ink at a desired position on a recording sheet. In conventional ink-jet printheads, ink ejection mechanisms are largely categorized into two types. Conventionally, there have been used a thermally driven type in which a heat source is employed to generate bubbles in ink to cause ink droplets to be ejected by an expansion force of the generated bubbles, and a piezoelectrically driven type in which ink is ejected by a pressure applied to ink due to deformation of a piezoelectric element.

FIGS. 1A and 1B illustrate examples of a conventional thermally driven ink-jet printhead. FIG. 1A illustrates a cutaway perspective view of a structure of a conventional ink-jet printhead. FIG. 1B illustrates a cross-sectional view of an ink ejection mechanism of the conventional ink-jet printhead shown in FIG. 1A.

The conventional thermally driven ink-jet printhead shown in FIGS. 1A and 1B includes a manifold 22 provided on a substrate 10, an ink channel 24 and an ink chamber 26 defined by a barrier wall 14 installed on the substrate 10, a heater 12 installed in the ink chamber 26, and a nozzle 16 that is provided on a nozzle plate 18 and through which ink droplets 29' are expelled. When a pulse current is supplied to the heater 12 and heat is generated in the heater 12, ink 29 filled in the ink chamber 26 is heated, and a bubble 28 is generated. The formed bubble 28 continuously expands and exerts pressure on the ink 29 contained within the ink chamber 26. This pressure causes the ink droplets 29' to be expelled through the nozzle 16. Subsequently, the ink 29 is absorbed from the manifold 22 into the ink chamber 26 through the ink channel 24, thereby refilling the ink chamber 26 with ink 29.

However, in the thermally driven ink-jet printhead, when ink droplets are expelled due to the expansion of bubbles, a portion of the ink in the ink chamber 26 flows backward to the manifold 22, and an ink refill operation is performed after ink is expelled. Thus, there is a limitation in implementing high-speed printing.

In addition to the above-described ink droplet ejection mechanisms, a variety of different ink droplet ejection mechanisms are used in ink-jet printheads, and another example is shown in FIG. 2. FIG. 2 illustrates an example of a conventional ink droplet ejection mechanism utilizing a principle of an atomizer.

Referring to FIG. 2, unmixed ink 40 of multiple colors is contained in a reservoir 34 of an ink cartridge 32. The reservoir 34 has a printhead 35 at a bottom surface thereof. The printhead 35 operates to dispense unmixed ink 40. The ink 40 dispensed through the printhead 35 is mixed in a mixing chamber 42, and a nozzle tube 44 is filled with the mixed ink. Compressed air delivered via a conduit 52 of an atomizer 50 is sprayed onto a front portion of an outlet 46 of the nozzle tube 44, causing a reduction in pressure at the front portion of the outlet 46 of the nozzle tube 44. Accordingly, ink in the nozzle tube 44 is expelled and atomized onto an object 49 in the form of droplets 48.

The ink-jet printhead expelling ink utilizing the principle of an atomizer requires a compressor for supplying compressed air. In particular, in order to adopt the above-described ink ejection mechanism to an ink-jet printhead having a plurality of nozzles, there is a demand for a complex series of air supply passages from the compressor to the plurality of nozzles. Thus, the printhead becomes bulky, which reduces the number of nozzles per unit area, i.e., a nozzle density. In addition, it is quite difficult to manufacture a printhead having several hundred or more nozzles. As a result, an operational printing resolution of the ink-jet printhead adopting the above-described ink ejection mechanism still remains at a level of several tens of dots per inch (DPI).

Accordingly, in order to implement an ink-jet printhead having high printing speed and high resolution, a new ink droplet ejection mechanism is needed.

SUMMARY OF THE INVENTION

The present invention provides a method of expelling a fluid from a nozzle by reducing a pressure in a front portion of an outlet of the nozzle using an ion wind.

The present invention also provides a high-integration, high-resolution ink-jet printhead utilizing the fluid expelling method.

According to a feature of an embodiment of the present invention, there is provided a method of expelling a fluid including filling a nozzle with a fluid using a capillary force, generating an ion wind by ionizing air near an outlet of the nozzle, and expelling the fluid from the nozzle as the ion wind decreases a pressure around the outlet of the nozzle.

In the method, the ionizing of air may be performed by an electric field formed between two electrodes disposed near the outlet of the nozzle. A volume and speed of the fluid expelled may be adjusted by varying voltages applied between the two electrodes and a time duration of voltage application. An expelling frequency of the fluid may be adjusted by varying a pulse period of the voltage applied to the electrodes.

In the method, the ion wind may flow toward the outlet of the nozzle and upward at a front portion of the outlet of the nozzle and may flow in an inclined direction toward the front portion of the outlet of the nozzle.

In the method, the fluid may be ink, the ink being expelled from an ink-jet printhead.

According to another feature of an embodiment of the present invention, there is provided an ink-jet printhead including a manifold formed in a passageway plate to supply ink, a nozzle to be supplied with ink formed in a nozzle plate provided on the passageway plate, the ink being supplied by a capillary force, and a ground electrode and a source electrode arranged near an outlet of the nozzle, the ground electrode and the source electrode forming an electric field due to an application of a voltage thereto and ionizing air near the outlet of the nozzle to produce an ion wind to decrease a pressure near the outlet of the nozzle to expel the ink contained in the nozzle.

In the ink-jet printhead, the ground electrode may be disposed adjacent the outlet of the nozzle and the source electrode may be disposed a predetermined distance from the ground electrode away from the outlet of the nozzle. The ion wind may flow toward the outlet of the nozzle and may flow upward at a front portion of the outlet of the nozzle.

An embodiment of the ink-jet printhead may further include a recess having a predetermined depth formed at a periphery of the outlet of the nozzle on a surface of the nozzle plate, the ground electrode and the source electrode being arranged within the recess. The recess may have a shape of a ring surrounding the nozzle. A side of the recess adjacent the outlet of the nozzle may be inclined to permit the ion wind to flow in an inclined direction toward a front portion of the outlet of the nozzle. The ground electrode may be disposed on a bottom of the recess or on the inclined side of the recess.

Another embodiment of the ink-jet printhead may further include an ion wind path for guiding the ion wind formed in the nozzle plate to surround the nozzle, the ground electrode and the source electrode being arranged within the ion wind path. The ion wind path may be shaped as a ring surrounding the nozzle. An outlet side of the ion wind path may be inclined to permit the ion wind to flow in an inclined direction toward a front portion of an outlet of the ion wind path. The ground electrode may be disposed on the inclined side of the ion wind path and the source electrode may be disposed a predetermined distance apart from the ground electrode. This embodiment of the ink-jet printhead may further include an air path for supplying the ion wind path with air formed in the nozzle plate to communicate with the ion wind path. The air path may be formed in a vertical, horizontal, or inclined direction and communicates with a lower portion of the ion wind path.

In the ink-jet printhead, the nozzle may have a tapered shape in which a cross-sectional area of the nozzle decreases gradually toward the outlet of the nozzle. The ground electrode and the source electrode may surround the outlet of the nozzle. A shape of the ground electrode and the source electrode may be circular, oval, or polygonal. The source electrode may have a cross-sectional area smaller than a cross-sectional area of the ground electrode.

In an embodiment of the ink-jet printhead, the source electrode may include a protrusion extending toward the ground electrode. The protrusion may be a plurality of protrusions provided at equidistant intervals along a lengthwise direction of the source electrode.

In the ink-jet printhead, the nozzle may be a plurality of nozzles, each formed in the nozzle plate, and one of a plurality of ground electrodes and one of a plurality of source electrodes are arranged near each of the plurality of nozzles, and wherein ink may be expelled from each of the plurality of nozzles simultaneously, sequentially, or individually.

BRIEF DESCRIPTION OF THE DRAWINGS

The above and other features and advantages of the present invention will become more apparent to those of ordinary skill in the art by describing in detail exemplary embodiments thereof with reference to the attached drawings in which:

FIGS. 1A and 1B illustrate an exemplary conventional ink-jet printhead, in which FIG. 1A illustrates a cutaway perspective view of a structure thereof and FIG. 1B illustrates a cross-sectional view for explaining an ink ejection mechanism thereof;

DETAILED DESCRIPTION OF THE INVENTION

Figure 1A:
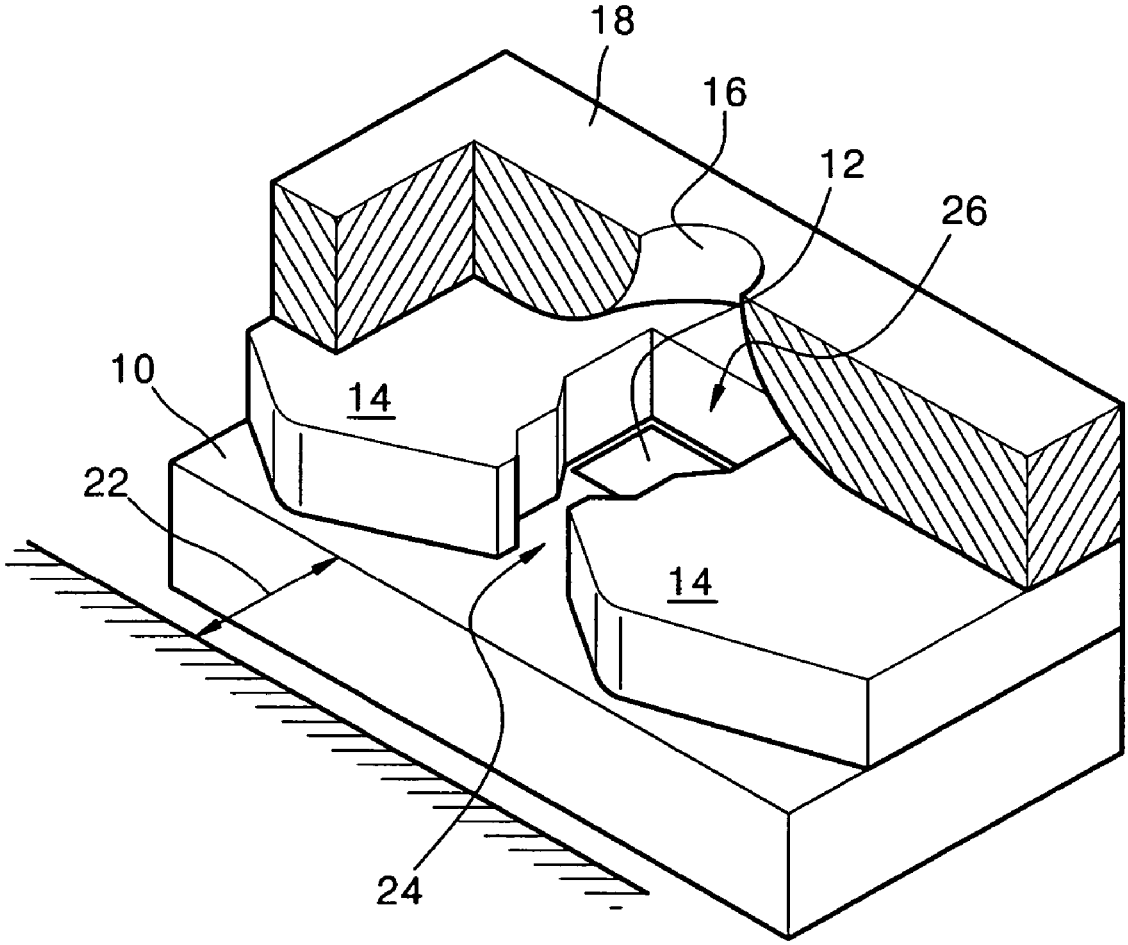
FIG. 1A (PRIOR ART)
Figure 1B:
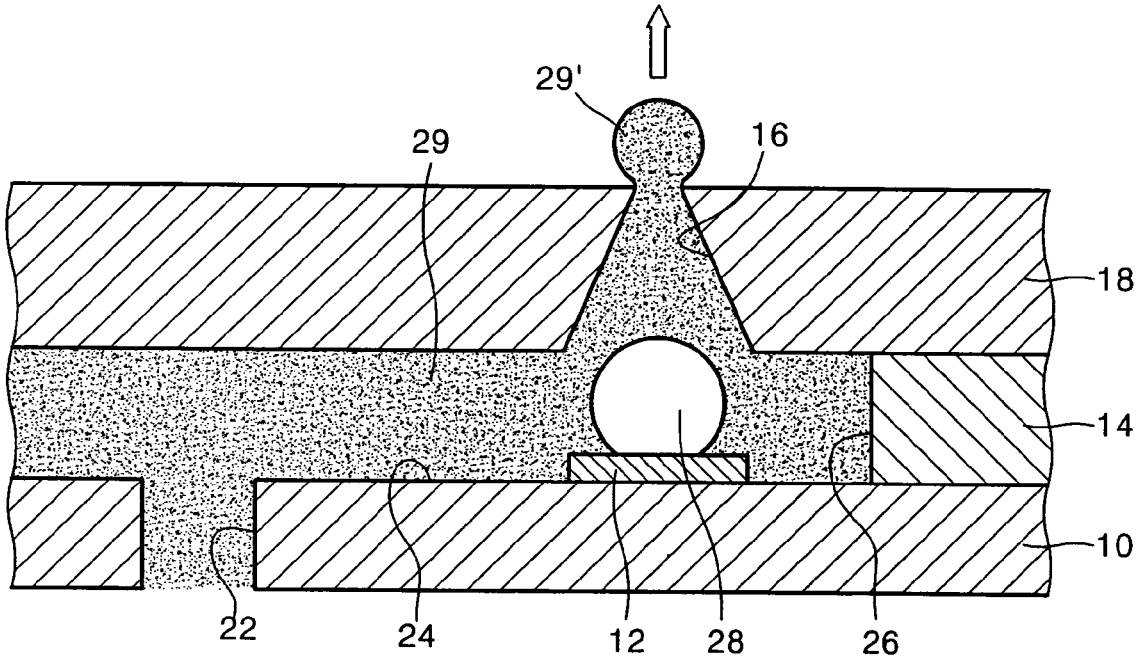
FIG. 1B (PRIOR ART)
Figure 2:
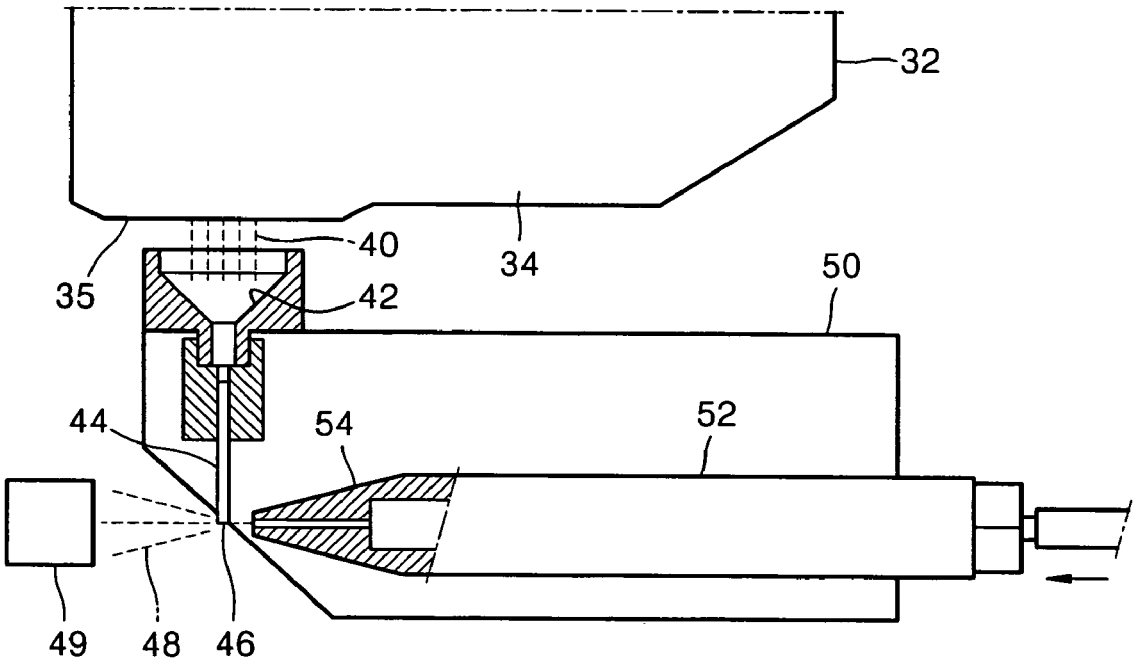
FIG. 2 (PRIOR ART)
FIG. 2 illustrates another exemplary conventional ink-jet printhead for explaining an ink ejection mechanism using an atomizer.

Korean Patent Application No. 2003-2728, filed on Jan. 15, 2003, and entitled: "Method of Expelling Fluid Using Ion Wind and Ink-Jet Printhead Adopting the Method," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the thickness of layers and regions are exaggerated for clarity. Like reference numerals refer to like elements throughout.

Figure 3A:
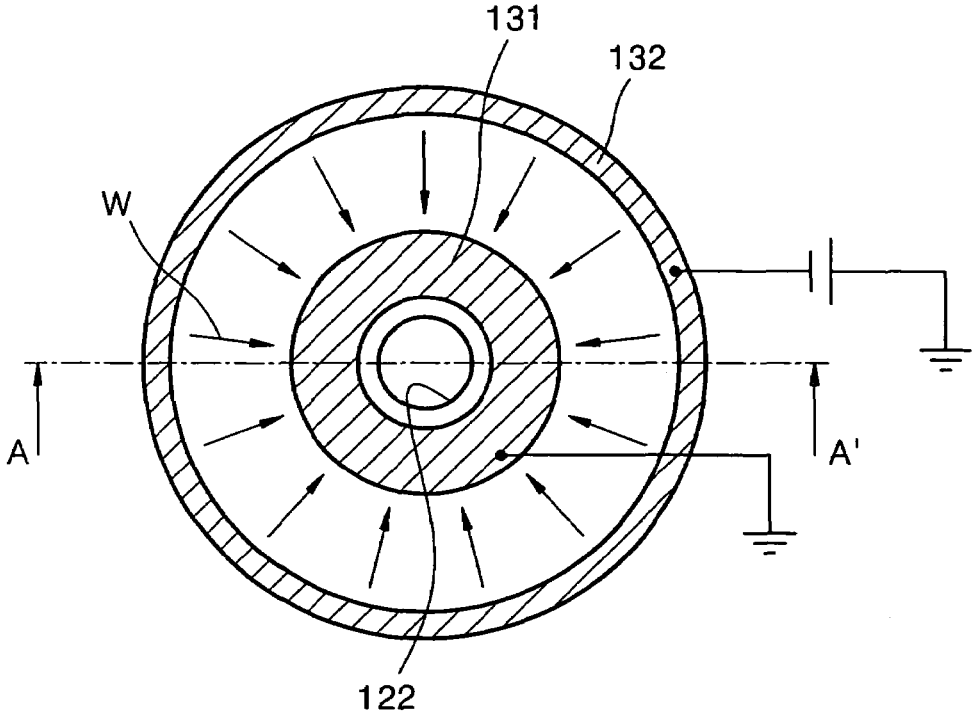
FIG. 3A illustrates a planar structure of an ink-jet printhead according to a first embodiment of the present invention and FIG. 3B illustrates a vertical cross-sectional view of the ink-jet printhead taken along line A–A' of FIG. 3A.
Figure 3B:
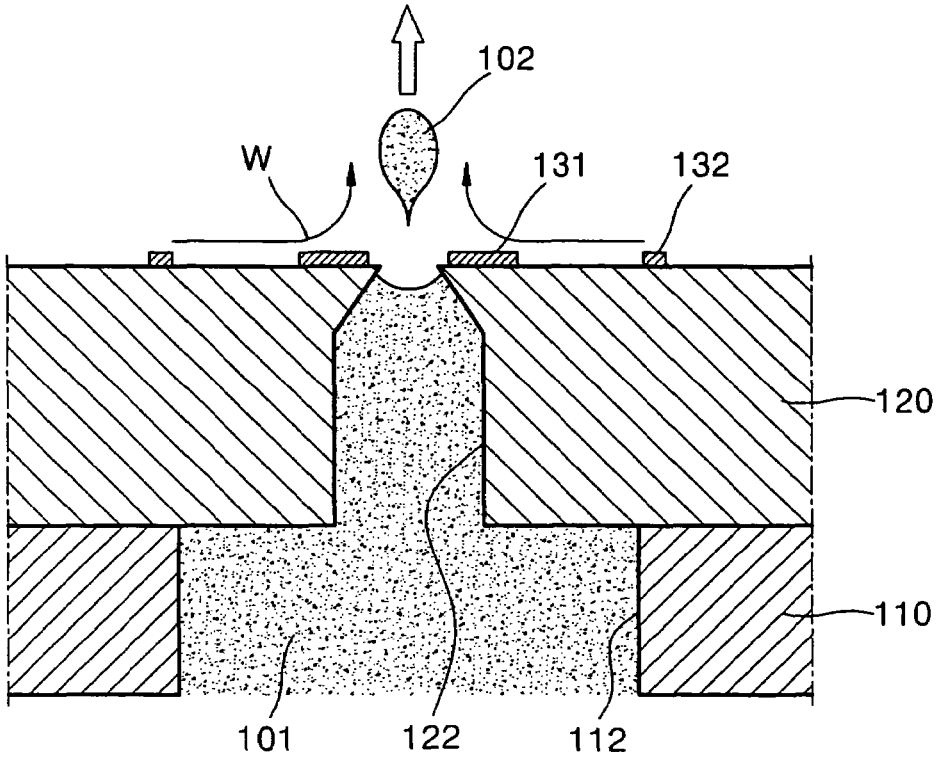

FIG. 3A illustrates a planar structure of an ink-jet printhead according to a first embodiment of the present invention. FIG. 3B illustrates a vertical cross-sectional view of the ink-jet printhead taken along line A–A' of FIG. 3A.

Although only a unit structure of the ink-jet printhead is shown in the drawings, a plurality of nozzles are provided in the ink-jet printhead manufactured in a form of chips.

Referring to FIGS. 3A and 3B, a manifold 112 is formed in a passageway plate 110 to supply ink 101, a nozzle 122 filled with ink 101 to be expelled is formed in a nozzle plate 120 formed on the passageway plate 110. The passageway plate 110 and the nozzle plate 120 may be integrally formed.

Ink 101 is supplied to the manifold 112 from an ink reservoir (not shown). Ink 101 in the manifold 112 moves to the nozzle 122 by a capillary force to fill the nozzle 122. Although the nozzle 122 preferably has a circular cross-sectional area, the nozzle 122 may have various shapes, including an oval or polygonal shape. Preferably, the nozzle 122 has a tapered shape in which a cross-sectional area of the nozzle 122 decreases gradually toward an outlet.

A ground electrode 131 and a source electrode 132 are spaced a predetermined distance apart from each other near an outlet of the nozzle 122. The ground electrode 131 is grounded, and a predetermined DC pulse or AC voltage is applied to the source electrode 132. The voltage applied to the ground electrode 131 and the source electrode 132 forms an electric field and ionizes ambient air present near the outlet of the nozzle 122, thereby producing an ion wind, which will be subsequently described in greater detail.

The ground electrode 131 and the source electrode 132 are preferably shaped to surround the outlet of the nozzle 122. For example, as shown, if the nozzle 122 has a circular cross-sectional shape, the ground electrode 131 and the source electrode 132 will also have a circular ring cross-sectional shape. However, if the nozzle 122 has an oval or polygonal cross-sectional shape, the cross-sectional shapes of the ground electrode 131 and the source electrode 132 may vary accordingly.

The ground electrode 131 may be disposed relatively near the outlet of the nozzle 122 while the source electrode 132 is disposed relatively far from the outlet of the nozzle 122, or the positions of the ground electrode 131 and the source electrode 132 may be reversed. The source electrode 132 has a cross-sectional area smaller than that of the ground electrode 131.

Figure 4:
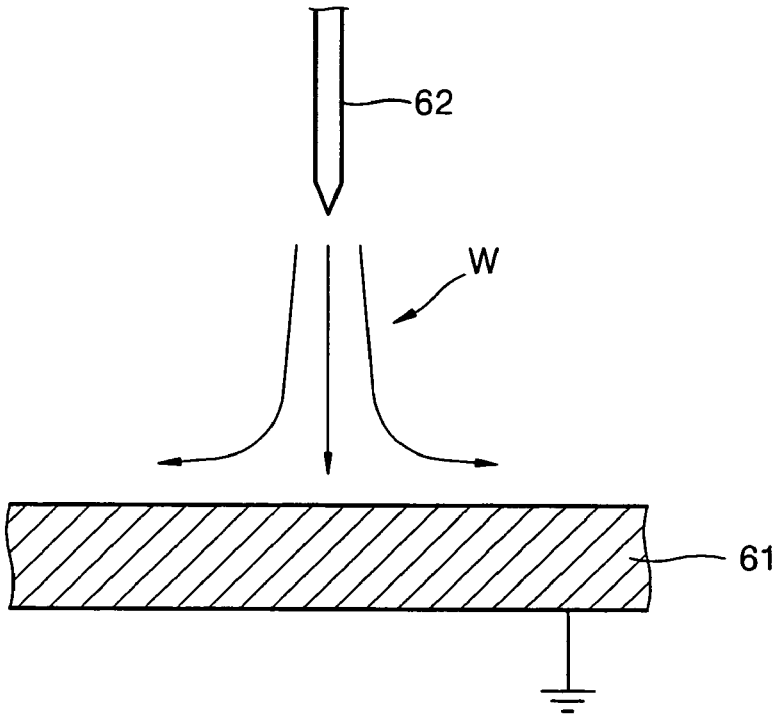
FIG. 4 is a diagram illustrating a mechanism of producing an ion wind.

The ink-jet printhead according to the first embodiment of the present invention is driven by an ink expelling mechanism in which ink is expelled from a nozzle using an ion wind generated in such a manner as shown in FIG. 4. Referring to FIG. 4, if a DC pulse or AC voltage of a sufficiently high voltage is applied to a source electrode 62 spaced a predetermined distance apart from a ground electrode 61, an electric field is formed between the ground electrode 61 and the source electrode 62. The electric field ionizes air present between the electrodes 61, 62, and the ionized air moves toward the ground electrode 61 having the opposite polarity, thus producing an ion wind W. The ion wind W is generated by a Coulomb force (F) equal to a product of an intensity (E) of the electric field and a quantity of ion charges (q), that is, $F=q*E$. If the ground electrode 61 has a shape of a plate having a relatively wide cross section and the source electrode 62 has a relatively narrow cross section, particularly if the source electrode 62 has a shape of a sharp tip, as shown in FIG. 4, a relatively strong electric field is formed at the end of the sharp tip, and the Coulomb force F producing the ion wind W increases accordingly.

Referring back to FIGS. 3A and 3B, an ink expelling mechanism of the ink-jet printhead according to the first embodiment of the present invention will now be described.

When a DC pulse or AC voltage of a voltage sufficiently high to ionize air is applied to the source electrode 132, an electric field is formed between the ground electrode 131 and the source electrode 132. The electric field ionizes air present between the electrodes 131, 132, and the ionized air moves toward the ground electrode 131 by a Coulomb force ($F=q*E$), and the ion wind W is produced accordingly. A speed of the produced ion wind W increases as the Coulomb force ($F=q*E$) applied to the ions within the electric field increases. As described above, if the ion wind W is generated near the outlet of the nozzle 122, a pressure near the outlet of the nozzle 122 is reduced, so that ink 101 within the nozzle 122 is expelled in the form of a droplet 102 based on the principle of an atomizer. As the ink droplet 102 is expelled, the nozzle 122 is refilled with ink 101 due to a capillary force.

In the above-described ink expelling mechanism, a volume and speed of the droplet 102 expelled may be adjusted by varying a voltage applied between the two electrodes 131, 132 and a time duration of voltage application. That is, if a voltage applied to the electrodes 131, 132 is increased, the speed of the ion wind W is increased and a difference in the pressure between an interior and outside the nozzle 122 is increased, thereby increasing the expelling speed of the droplet 102. Therefore, a response speed of the nozzle 122, which depends on a signal indicative of ink expelled, the signal transferred via the source electrode 132, is increased. If the voltage application time is reduced, a volume of the droplet 102 of ink expelled becomes reduced. An expelling frequency of the droplet 102 may be adjusted by varying a pulse period of the voltage applied. Therefore, a desired volume of the ink droplet 102 may be expelled at a desired frequency. As the ink droplet 102 is expelled, the ink 101 refills the nozzle 122 by a capillary force. In addition, backflow of the ink 101 does not occur in the nozzle 122. Thus, only a short period of time is required for ink refill, thereby allowing the ink droplet 102 to be expelled at a high frequency.

Although the ink 101 in the nozzle 122 is driven by the ion wind W that horizontally moves from one side of the nozzle 122 to the opposite side thereof, it is preferable to make the ion wind W converge and flow upward at a front portion of an outlet of the nozzle 122, which is because the ion wind W preferably adaptively moves in an expelling direction of the ink droplet 102. To this end, the electrodes 131, 132 are arranged to surround the nozzle 122, respectively. Preferably, the ground electrode 131 is disposed adjacent to the outlet of the nozzle 122 and the source electrode 132 is disposed a predetermined distance apart from the ground electrode 131 away from the outlet of the nozzle 122. Such an arrangement of the electrodes 131, 132 allows the ion wind W to flow toward the outlet of the nozzle 122 and allows the ion wind W to flow upward at the front portion of the outlet of the nozzle 122.

Figure 5:
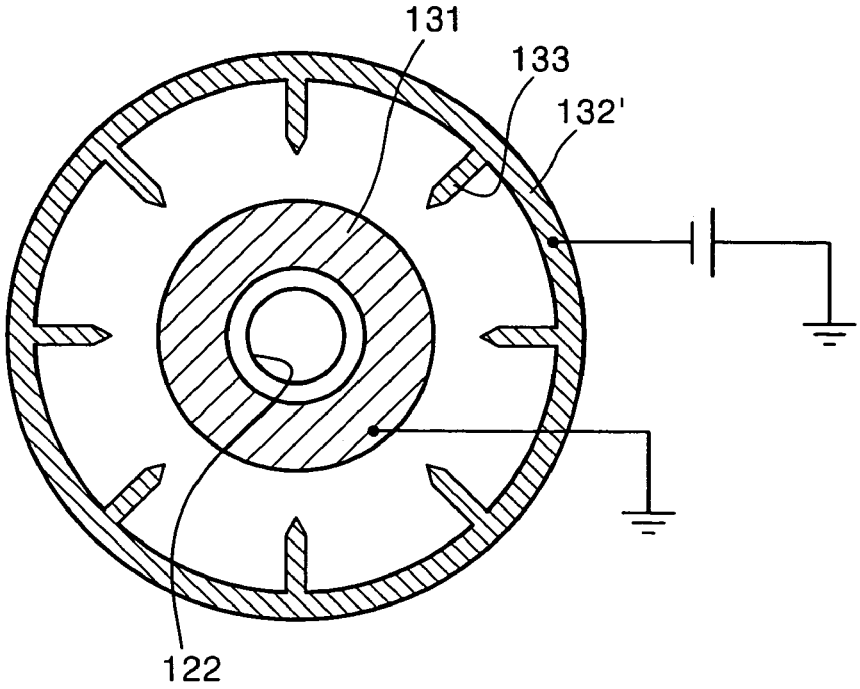
FIG. 5 illustrates a modification of a source electrode shown in FIG. 3A.

FIG. 5 illustrates a modification of a source electrode shown in FIG. 3A.

Referring to FIG. 5, a protrusion 133 protruding toward the ground electrode 131 is provided in the source electrode 132'. Preferably, a plurality of protrusions 133 is provided at equidistant intervals along a lengthwise direction of the source electrode 132'. The source electrode 132' having the protrusions 133 is able to form a relatively strong electric field between the electrodes 131, 132' as shown in FIG. 4, and the Coulomb force producing an ion wind W increases accordingly, thereby creating a sufficiently fast ion wind using only a relatively low voltage.

Figure 6:
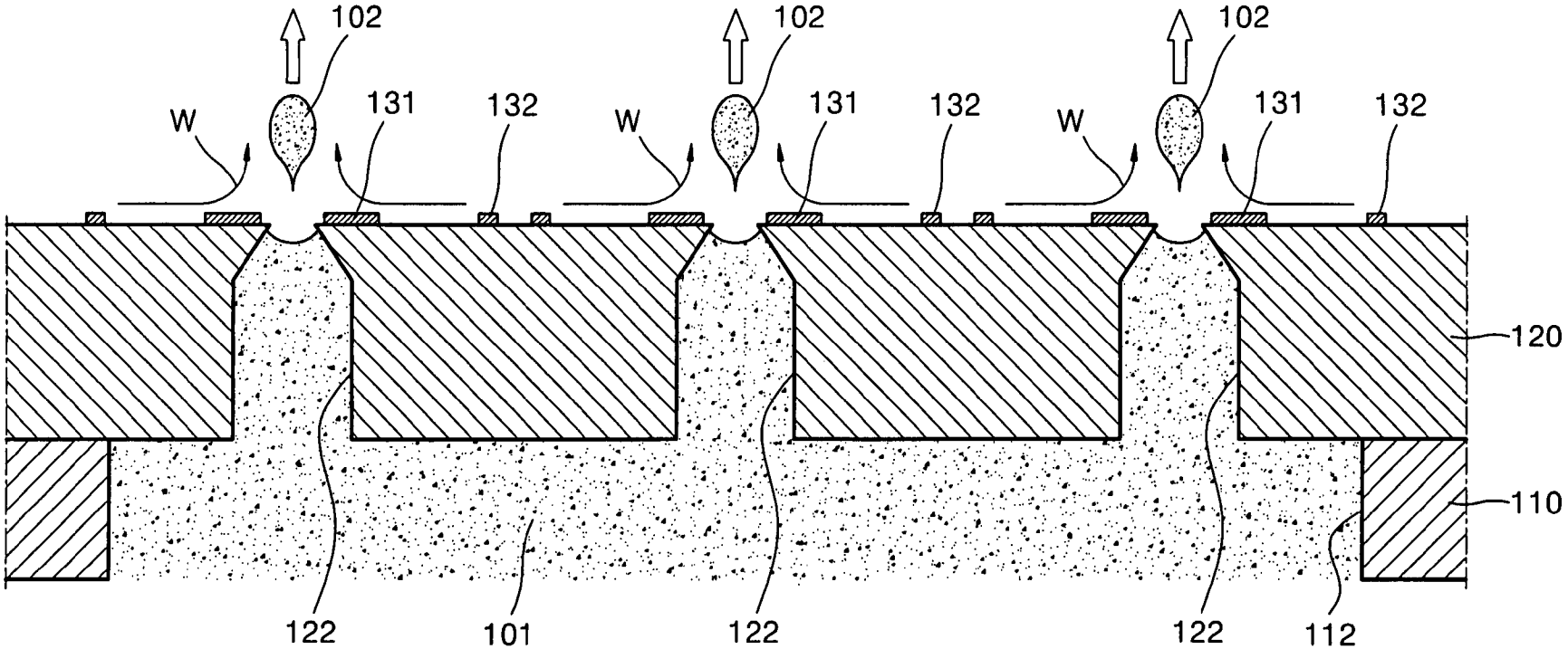
FIG. 6 illustrates an exemplary ink-jet expelling method according to an embodiment of the present invention adopted to an ink-jet printhead having a plurality of nozzles.

FIG. 6 illustrates an exemplary ink expelling method according to an embodiment of the present invention adapted to an ink-jet printhead having a plurality of nozzles. Referring to FIG. 6, a manifold 112 is formed in a passageway plate 110 and a plurality of nozzles 122 in communication with the manifold 112 are arranged in the nozzle plate 120 in an exemplary three rows. Although only a unit structure of the ink-jet printhead having the plurality of nozzles 122 arranged in three rows has been shown in the drawings, they may be arranged in one or two rows, or in four or more rows to achieve a higher resolution in an ink-jet printhead. The ground electrode 131 and the source electrode 132 are arranged near each of the plurality of nozzles 122 as described above.

In this structure, the ink droplet 102 may be simultaneously expelled from the respective nozzles 122 by simultaneously applying a voltage to the respective source electrodes 132. In addition, the ink droplet 102 may be sequentially expelled from the respective nozzles 122 by applying voltages at a time interval to the respective source electrodes 132. Alternatively, the ion wind W may be produced only around the outlet of one selected nozzle by applying a voltage to only one of the source electrodes 132, thereby expelling the ink droplet 102 only from the selected nozzle.

Since the electrodes 131, 132 are formed in a form of micro droplets using a semiconductor manufacturing process, the ink-jet printhead according to this embodiment of the present invention has a simplified structure, as compared to the conventional ink-jet printhead in which ink is expelled by compressed air. Therefore, the ink-jet printhead having the plurality of nozzles 122 can be easily manufactured, thereby implementing a high-integration, high-resolution ink-jet printhead. Since a relatively small voltage, i.e., several to several tens of volts, is applied to the source electrode 132, that is, a relatively small amount of power is consumed in producing the ion wind W, an ink-jet printhead having a small power consumption can be manufactured.

Figure 7:
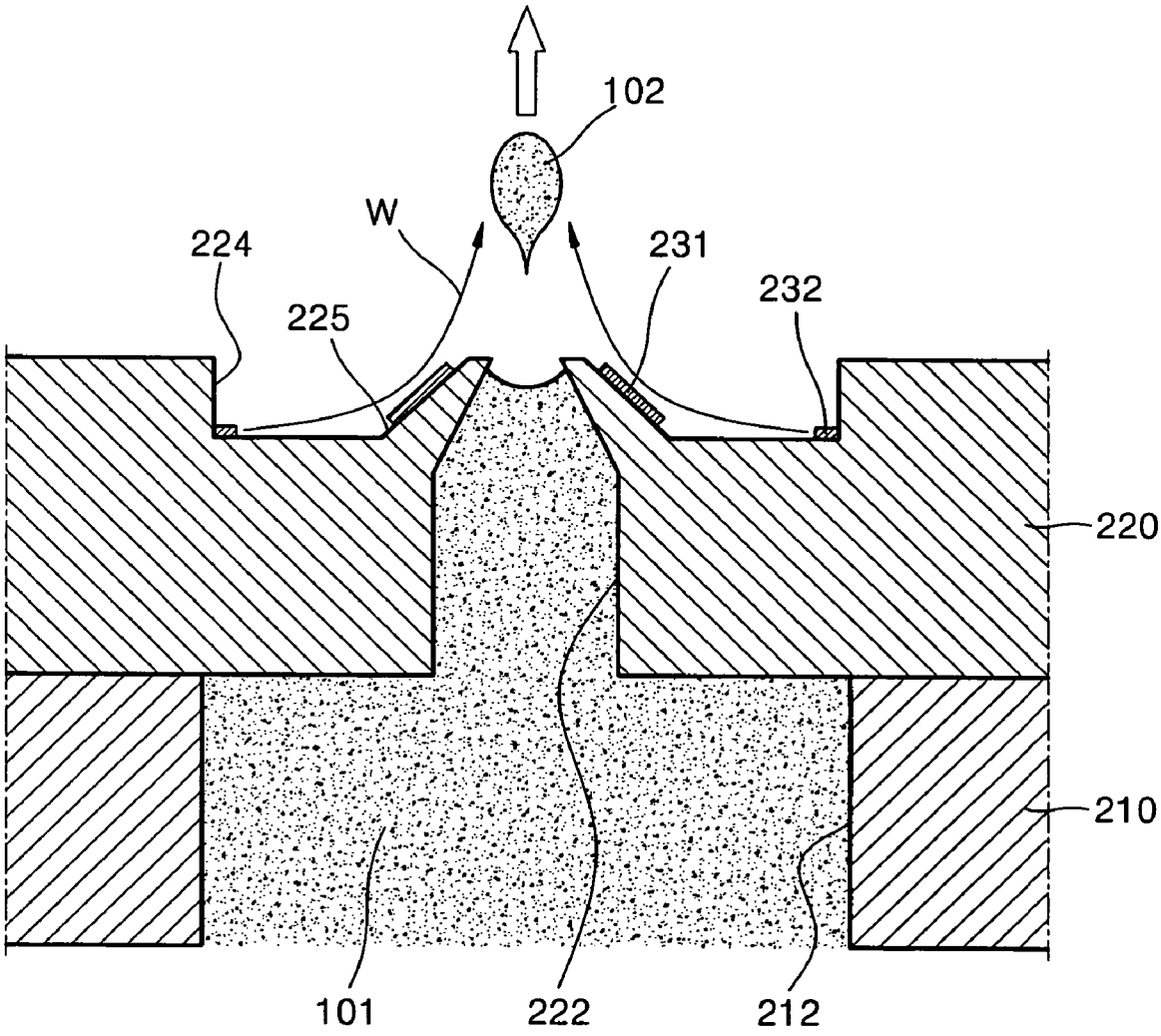
FIG. 7 illustrates a vertical cross-sectional view of an ink-jet printhead according to a second embodiment of the present invention.

FIG. 7 illustrates a vertical cross-sectional view of an ink-jet printhead according to a second embodiment of the present invention.

As shown in FIG. 7, the ink-jet printhead according to the second embodiment of the present invention has a similar structure as that of the ink-jet printhead according to the first embodiment of the present invention, except that a recess 224 having a predetermined depth is formed at a periphery of an outlet of a nozzle 222. An explanation of a difference between the ink-jet printheads according to the first and second embodiments of the present invention follows.

Referring to FIG. 7, a manifold 212 containing ink 101 is formed in a passageway plate 210, a nozzle 222 filled with the ink 101 is formed in a nozzle plate 220 formed on the passageway plate 210. The recess 224 having a predetermined depth is formed at a periphery of the outlet of the nozzle 222 on a surface of the nozzle plate 220. A ground electrode 231 and a source electrode 232 are arranged within the recess 224.

The recess 224 is preferably shaped as a ring surrounding the nozzle 222 to accommodate a ring-shaped ground electrode 231 and source electrode 232. A side 225 of the nozzle 222 adjacent the outlet of the nozzle is preferably inclined to permit the ion wind W produced in the recess 224 to flow in an inclined direction toward a front portion of an outlet of the nozzle 222, thereby facilitating an upward flow of the ion wind W at the front portion of the outlet of the nozzle 222.

The ground electrode 231 may be installed on a bottom of the recess 224, or it may be installed on the inclined side 225 of the recess 224 for the purpose of facilitating flow of the ion wind W. In this embodiment, the source electrode 232 is installed on a bottom at an outer peripheral side of the recess 224.

The nozzle 222 preferably has a tapered shape in which a cross-sectional area decreases gradually toward an outlet. As is well known, this configuration permits a meniscus formed on a surface of the ink 101 in the nozzle 222 to extend upward quickly to be stabilized. The shape of the nozzle 222 conforms to that of the recess 224 formed in the periphery thereof.

In the second embodiment, the arrangement and shape of the electrodes 231, 232 are the same as those of the first embodiment. The source electrode 232 according to the second embodiment also may have the same shape as shown in FIG. 5. In addition, the ink-jet printhead according to the second embodiment also may have a plurality of nozzles, as shown in FIG. 6.

Figure 8:
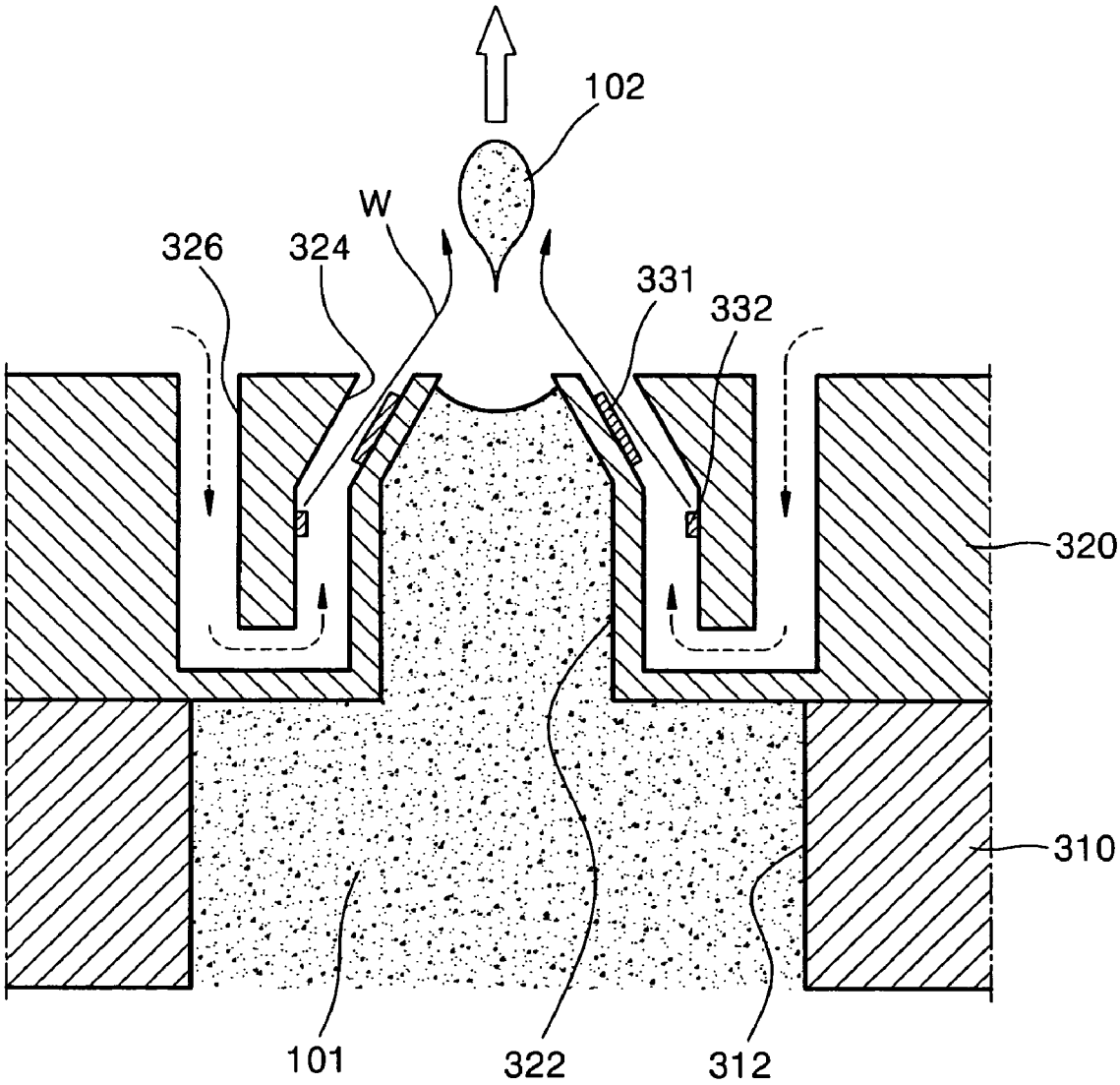
FIG. 8 illustrates a vertical cross-sectional view of an ink-jet printhead according to a third embodiment of the present invention.

FIG. 8 illustrates a vertical cross-sectional view of an ink-jet printhead according to a third embodiment of the present invention.

As shown in FIG. 8, the ink-jet printhead according to the third embodiment of the present invention has a structure similar to the structure of the ink-jet printhead according to the first embodiment of the present invention, and only an explanation of a difference between the ink-jet printheads according to the first and third embodiments of the present invention will be given.

Referring to FIG. 8, a manifold 312 containing ink 101 is formed in a passageway plate 310, a nozzle 322 filled with the ink 101 by a capillary force is formed in a nozzle plate 320. An ion wind path 324 for guiding the ion wind W is formed in the nozzle plate 320 to surround the nozzle 322. A ground electrode 331 and a source electrode 332 are arranged within the ion wind path 324.

The ion wind path 324 is preferably shaped as a ring surrounding the nozzle 322 to accommodate a ring-shaped ground electrode 331 and source electrode 332. An outlet side of the ion wind path 324 is preferably inclined to permit the ion wind W produced in the ion wind path 324 to flow in an inclined direction toward a front portion of the outlet of the ion wind path 324, thereby facilitating an upward flow of the ion wind W at the front portion of the outlet of the nozzle 322.

The ground electrode 331 is disposed at an inclined portion of the ion wind path 324, and the source electrode 332 is spaced a predetermined distance apart from the ground electrode 331 to be disposed at a deeper portion of the ion wind path 324. Such an arrangement is preferred in view of the formation of the flow of the ion wind W.

An air path 326 for supplying the ion wind path 324 with air is formed in the nozzle plate 320 to communicate with the ion wind path 324. The air path 326 is preferably formed in a vertical direction, as shown in FIG. 8, and communicates with the ion wind path 324 at a lower portion thereof. The air path 326 may also be formed either in a horizontal direction or in an inclined direction. Accordingly, the position and shape of the air path 326 may vary within a limit in which it is capable of supplying the ion wind path 324 with air.

In addition, for the foregoing reasons, it is preferable that the nozzle 322 has a tapered shape in which a cross-sectional area decreases gradually toward an outlet.

In the third embodiment, the arrangement and shape of the electrodes 331, 332 are the same as those of the first embodiment. The source electrode 332 according to the third embodiment may also have the same shape as shown in FIG. 5. In addition, the ink-jet printhead according to the third embodiment may also have a plurality of nozzles, as shown in FIG. 6.

As described above, according to the fluid expelling method of the present invention, a volume and speed of the fluid expelled may be adjusted finely and accurately by varying voltages applied between two electrodes and a time duration of voltage application. An expelling frequency of the fluid may be adjusted by varying a pulse period of the voltage applied. As the fluid is expelled from nozzles, the fluid refills the nozzles. In addition, backflow of the fluid does not occur in the nozzles and a separate time for refilling is not required, thereby enabling the fluid to be expelled at a higher frequency.

Since the ink-jet printhead according to the embodiments of the present invention is constructed such that electrodes producing an ion wind are arranged near a plurality of nozzles and the electrodes are miniaturized, it has a simplified structure as compared to the conventional ink-jet printhead in which ink is expelled by compressed air. Since manufacture of an ink-jet printhead having a plurality of nozzles may be performed easily, a high-integration, high-resolution ink-jet printhead may be easily implemented. Further, since power consumption for producing an ion wind is relatively small, low power consuming ink-jet printheads can be manufactured.

Preferred and exemplary embodiments of the present invention have been disclosed herein and, although specific terms are employed, they are used and are to be interpreted in a generic and descriptive sense only and not for purpose of limitation. For example, the ink expelling method according to the present invention may be applied to a general fluid ejection system in which a small amount of fluid is expelled through nozzles as well as the ink-jet printheads shown and described in the exemplary embodiments of the present invention. Accordingly, it will be understood by those of ordinary skill in the art that various changes in form and details may be made without departing from the spirit and scope of the present invention as set forth in the following claims.

What is claimed is:

1. A method of expelling a fluid comprising:

filling a nozzle with a fluid using a capillary force;

using a ground electrode and a source electrode to generate an ion wind by ionizing air near an outlet of the nozzle; and expelling the fluid from the nozzle as the ion wind decreases a pressure around the outlet of the nozzle, wherein the ground electrode is disposed adjacent the outlet of the nozzle and the source electrode is disposed a predetermined distance from the ground electrode away from the outlet of the nozzle.

2. The method as claimed in claim 1, wherein a volume and speed of the fluid expelled are adjusted by varying voltages applied between the ground and source electrodes and a time duration of voltage application.

3. The method as claimed in claim 1, wherein an expelling frequency of the fluid is adjusted by varying a pulse period of the voltage applied to the ground and source electrodes.

4. The method as claimed in claim 1, wherein the ion wind flows toward the outlet of the nozzle and upward at a front portion of the outlet of the nozzle.

5. The method as claimed in claim 4, wherein the ion wind flows in an inclined direction toward the front portion of the outlet of the nozzle.

6. The method as claimed in claim 1, wherein the fluid is ink expelled from an ink-jet printhead.

7. An ink-jet printhead, comprising:

a manifold formed in a passageway plate to supply ink;

a nozzle to be supplied with ink formed in a nozzle plate provided on the passageway plate, the ink being supplied by a capillary force; and a ground electrode and a source electrode arranged near an outlet of the nozzle, the ground electrode and the source electrode forming an electric field due to an application of a voltage thereto and ionizing air near the outlet of the nozzle to produce an ion wind to decrease a pressure near the outlet of the nozzle to expel the ink contained in the nozzles, wherein the ground electrode is disposed adjacent the outlet of the nozzle and the source electrode is disposed a predetermined distance from the ground electrode away from the outlet of the nozzle.

8. The ink-jet printhead as claimed in claim 7, wherein the ion wind flows toward the outlet of the nozzle and flows upward at a front portion of the outlet of the nozzle.

9. The ink-jet printhead as claimed in claim 7, further comprising:

a recess having a predetermined depth formed at a periphery of the outlet of the nozzle on a surface of the nozzle plate, the ground electrode and the source electrode being arranged within the recess.

10. The ink-jet printhead as claimed in claim 9, wherein the recess has a shape of a ring surrounding the nozzle.

11. The ink-jet printhead as claimed in claim 9, wherein a side of the recess adjacent the outlet of the nozzle is inclined to permit the ion wind to flow in an inclined direction toward a front portion of the outlet of the nozzle.

12. The ink-jet printhead as claimed in claim 11, wherein the ground electrode is disposed on a bottom of the recess or on the inclined side of the recess.

13. The ink-jet printhead as claimed in claim 7, further comprising:

an ion wind path for guiding the ion wind formed in the nozzle plate to surround the nozzle, the ground electrode and the source electrode being arranged within the ion wind path.

14. The ink-jet printhead as claimed in claim 13, wherein the ion wind path is shaped as a ring surrounding the nozzle.

15. The ink-jet printhead as claimed in claim 13, wherein an outlet side of the ion wind path is inclined to permit the ion wind to flow in an inclined direction toward a front portion of an outlet of the ion wind path.

16. The ink-jet printhead as claimed in claim 15, wherein the ground electrode is disposed on the inclined side of the ion wind path and the source electrode is disposed a predetermined distance apart from the ground electrode.

17. The ink-jet printhead as claimed in claim 13, further comprising:

an air path for supplying the ion wind path with air formed in the nozzle plate to communicate with the ion wind path.

18. The ink-jet printhead as claimed in claim 17, wherein the air path is formed in a vertical, horizontal, or inclined direction and communicates with a lower portion of the ion wind path.

19. The ink-jet printhead as claimed in claim 7, wherein the nozzle has a tapered shape in which a cross-sectional area of the nozzle decreases gradually toward the outlet of the nozzle.

20. The ink-jet printhead as claimed in claim 7, wherein the ground electrode and the source electrode surround the outlet of the nozzle.

21. The ink-jet printhead as claimed in claim 7, wherein a shape of the ground electrode and the source electrode is selected from the group consisting of circular, oval, and polygonal.

22. The ink-jet printhead as claimed in claim 7, wherein the source electrode has a cross-sectional area smaller than a cross-sectional area of the ground electrode.

23. The ink-jet printhead as claimed in claim 7, wherein the source electrode comprises:

a protrusion extending toward the ground electrode.

24. The ink-jet printhead as claimed in claim 23, wherein the protrusion is a plurality of protrusions provided at equidistant intervals along a lengthwise direction of the source electrode.

25. The ink-jet printhead as claimed in claim 7, wherein the nozzle is a plurality of nozzles, each formed in the nozzle plate, and one of a plurality of ground electrodes and one of a plurality of source electrodes are arranged near each of the plurality of nozzles, and wherein ink may be expelled from each of the plurality of nozzles simultaneously, sequentially, or individually.

* * * * *